United States Patent [19]

Lusty

[11] Patent Number: 4,785,650

[45] Date of Patent: Nov. 22, 1988

[54] TUBE PIPE BENDER ASSEMBLY

[75] Inventor: Michael W. Lusty, Braintree, England

[73] Assignee: M. W. Lusty Limited, Worthing, England

[21] Appl. No.: 143,229

[22] Filed: Jan. 6, 1988

Related U.S. Application Data

[63] Continuation of Ser. No. 839,428, Mar. 13, 1986, abandoned.

[30] Foreign Application Priority Data

Mar. 15, 1985 [GB] United Kingdom ..... 8506727

[51] Int. Cl.[4] ..... B21D 7/024; B21D 7/14

[52] U.S. Cl. ..... 72/217; 33/529; 72/34; 72/321; 72/461

[58] Field of Search ..... 72/217, 218, 219, 216, 72/321, 322, 458, 459, 387, 388, 318, 320, 307, 31, 33, 461, 32, 34, 37; 29/407, 423, 33 D, 33 G, 33 T, 720, 721; 33/529

[56] References Cited

U.S. PATENT DOCUMENTS

| | | | |
|---|---|---|---|
| 2,153,935 | 4/1939 | Neukirch | 72/217 |
| 2,346,371 | 4/1944 | Fink | 72/219 |
| 2,447,909 | 8/1948 | Hunziker | 72/318 |
| 2,687,162 | 8/1954 | Smith | 72/321 X |
| 3,043,360 | 7/1962 | Hutchison | 72/219 |
| 3,447,353 | 6/1969 | Noveske | 72/217 |
| 4,249,405 | 2/1981 | Cyr | 72/34 |

FOREIGN PATENT DOCUMENTS

| | | | |
|---|---|---|---|
| 546281 | 11/1922 | France | 72/219 |
| 251765 | 2/1927 | Italy | 72/219 |
| 461975 | 2/1937 | United Kingdom | 72/217 |

*Primary Examiner*—Robert L. Spruill
*Assistant Examiner*—Steven B. Katz
*Attorney, Agent, or Firm*—Harness, Dickey & Pierce

[57] ABSTRACT

A pipe bender assembly comprising a pipe bender and a pipe clamp (36) cooperable therewith, the pipe bender including a body (10), a main die (12) forming part of, or mounted on the body, the main die having at least one part annular groove on its periphery. A circular shaping die (16) having an annular groove on its periphery and rotatable about its own axis, which is parallel to the axis of the main die, is supported on a mounting (16) so that it is rotatable about the axis of the main die. The mounting (16) is drivable by a reduction gear (20,22,24,26). An abutment surface (32) is formed on the body of the pipe bender and the pipe clamp has a pipe receiving bore therethrough and an outer surface including at least two faces (50,58) each selectively engageable accurately with the abutment surface to position temporarily the pipe clamp with respect to the pipe bender, the faces (50,58) extending at an angle to one another when viewed along the axis of the pipe receiving bore.

5 Claims, 2 Drawing Sheets

TUBE PIPE BENDER ASSEMBLY

This is a continuation of U.S. application Ser. No. 839,428, filed Mar. 13, 1986, now abandoned.

FIELD OF THE INVENTION

The present invention relates to a pipe bender assembly.

BACKGROUND OF THE INVENTION

There are various forms of well known pipe bender available, one of which includes a main die forming part of or mounted on a body, the main die having a part-annular concave groove on its periphery. A circular shaping die having an annular concave groove on its periphery is rotatable about its own axis, which is parallel to the axis of the main die, the shaping die being supported on a mounting so that it is rotatable about the axis of the main die. The mounting can be driven by hand or by a reduction gear.

Such a pipe bender is very satisfactory for the actual operation of bending a pipe and the only difficulty arises in bending the pipe accurately by the right amount at the right place. This has hitherto been determined largely by the skill of the operator.

SUMMARY OF THE INVENTION

It is now proposed, according to the present invention, to provide a pipe bender assembly comprising a pipe bender and a pipe clamp cooperable therewith, the pipe bender including a body, a main die forming part of, or mounted on said body, said main die having an at least part annular concave groove on its periphery, a circular shaping die having an annular concave groove on its periphery and rotatable about its own axis, which is parallel to the axis of the main die, the shaping die being supported on a mounting, so that it is rotatable about the axis of the main die, the mounting being drivable by a reduction gear and an abutment surface on the body of the pipe bender, the pipe clamp having a pipe receiving bore therethrough and an outer surface including at least two faces each selectively engageable accurately with the abutment surface to position temporarily the pipe clamp with respect to the pipe bender, said faces extending at an angle to one another when viewed along the axis of the pipe receiving bore.

With such a construction, the assembly can be used by a relative amateur such as a do-it-yourself man. He will be able, using the assembly, accurately to bend pipe at the correct place and by the right amount if he is given adequate instruction. These instructions will be in the form of a drawing and the drawing is provided with appropriate markings thereon. The user places the clamp on the pipe to be bent, and then places the pipe and the clamp on the drawing and adjusts the position of the clamp on the pipe so that it registers with a particular predetermined marking on that drawing. He then offers up the pipe together with the clamp to the pipe bender and engages one of the said at least two faces against the abutment. This will position temporarily the pipe clamp with respect to the pipe bender in exactly the right place so that the bender, when subsequently operated, will produce the correct bend at the correct position.

If one subsequently wishes to place a bend so that it extends in a different plane, then one goes back to another part of the drawing and sets the clamp up against the appropriate marking thereon and applies another one of the faces to the abutment prior to operating the bender.

Preferably, the pipe receiving bore through the clamp forms a tangent to one flat face which is at an angle to said at least two faces. In this way the pipe itself can be arranged to rest on the drawing and the clamp can be moved along the drawing to the correct position. Advantageously, the clamp is provided with a clamping screw enabling the bore to be closed on the pipe to be bent and secured thereto.

The clamp may take any form, and in one particularly simple construction, it is in the form of a rectangular block and said at least two faces are parallel to the axis of the bore and perpendicular to one another.

Again the abutment can take many forms and in one simple arrangement it comprises a member mounted on the body and forming an angle therewith into which the clamp can be engaged with one of the faces in engagement with the abutment.

In order to enable the assembly to be operated easily, the body preferably includes a plate mountable in a vice so that the axis of the main die is substantially vertical.

The main die is preferably provided with angular gradations to indicate the angle by which the pipe is being bent.

In order that the invention may more readily be understood, the following description is given, merely by way of example, reference being made to the accompanying drawings.

DETAILED DESCRIPTION OF PRESENTLY PREFERRED EMBODIMENT

Figure 1:
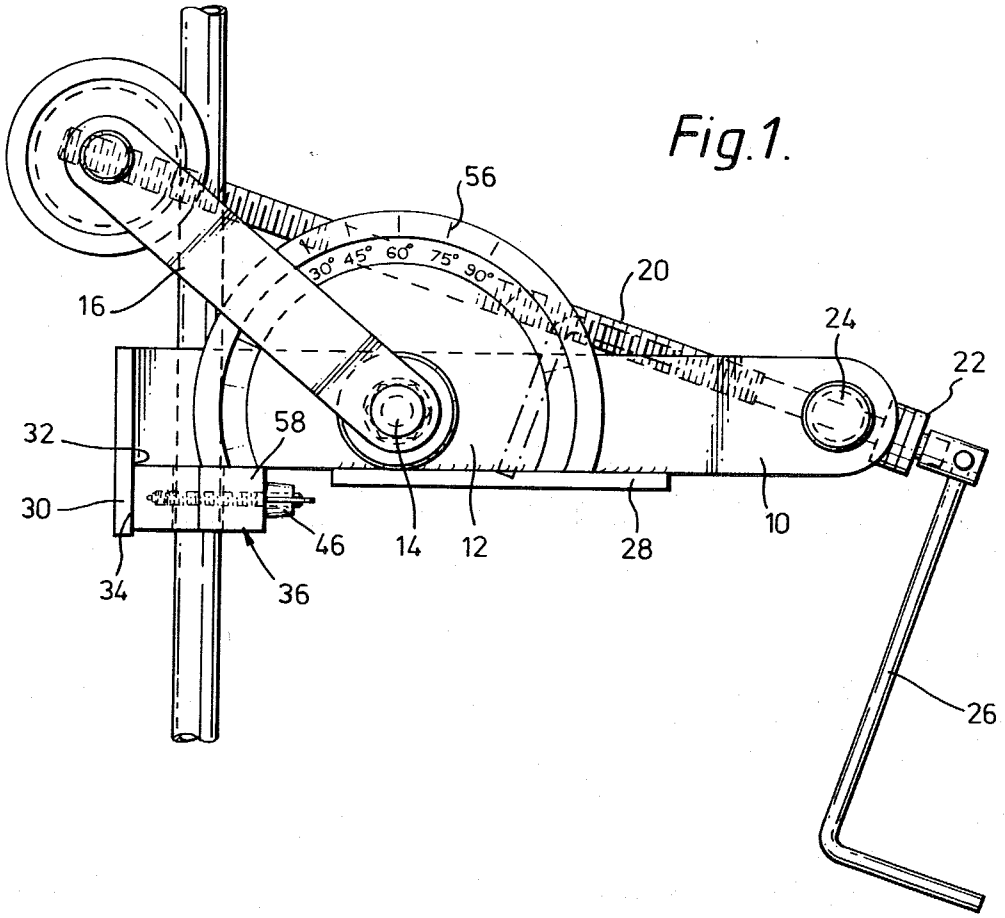
FIG. 1 is a top plan view of bender forming part of an assembly according to the present invention.

Referring first to FIG. 1, the pipe bender includes a body 10 having secured thereto a part-circular main die 12 having a peripheral groove in a conventional manner. Pivotally mounted for rotation about the centre 14 of the main die, is a mounting arm 16 which carries at its free end a circular shaping die 18 again having a peripheral semicircular concave groove. The arm 16 can be caused to rotate about the axis 14 by a screwthreaded rod 20 which passes through a nut 22 mounted on a pivotal bearing 24 carried by the body 10. An operating handle 26 may be provided to rotate the rod 20 which, together with the nut 22 forms a reduction gear. These parts are generally similar to the parts of a conventional car jack and can in fact utilize parts of such a jack.

The body 10 carries a vertically extending mounting plate 28 which, thus, extends parallel to the axis 14 of the main die. An abutment plate 30 is secured to the end of the body 10 and extends perpendicular to the plate 28, the plate 28 extending downwardly in FIG. 1 and the plate 30 extending upwardly.

Engageable against an abutment surface 32 of the abutment plate 30 is a surface 34 of a clamp 36. This clamp 36 is illustrated more clearly in FIG. 2 and is of generally rectangular configuration including two parts 38, 40, the part 38 having a stud 42 secured in a bore therein, this stud 42 passing through a bore 44 in the part 40 and being engageable by a wing nut 46 so that the two parts can be urged towards one another.

Figure 2:
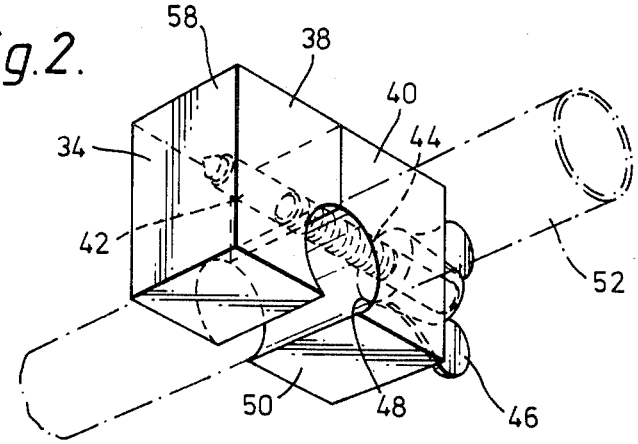
FIG. 2 is a perspective view of a clamp usable with the bender of FIG. 1.

Passing through the clamp 36 is a bore 48 positioned to be at a tangent to the surface 50 which extends parallel to the axis of the bore 48. The surface 34 is illustrated in FIG. 2 and is itself perpendicular to the surface 50 and parallel to the axis of the bore 48.

Figure 3:
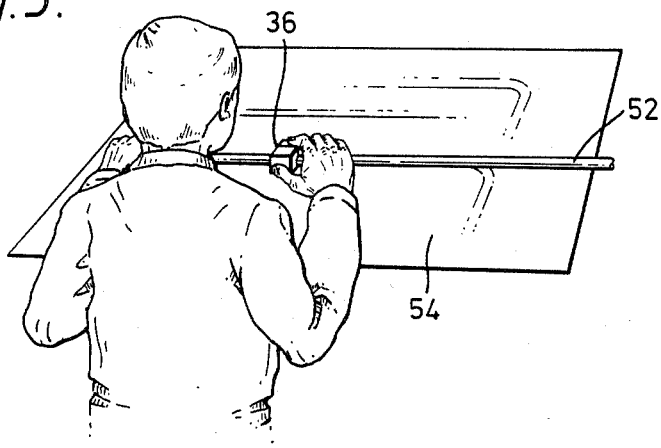
FIG. 3 is a schematic view showing the clamp being set up on the pipe to be bent by means of an instruction drawing.

In use of the above device, if reference is first made to FIG. 3, one places the pipe 52 on the drawing 54 and having placed the stop 36 on the pipe 52 previously. The stop is then slid along the pipe until it is in register with a particular marking (not shown) on the drawing 54 for the particular bend to be made.

Having previously mounted on the plate 28 in a vice so that the axis 14 extends generally vertically, one then positions the pipe 52 with the clamp 36 secured thereon (this securing having been effected by tightening up the wing nut 46) so that the surface 34 is engaged against the surface 32 of the abutment plate 30. The pipe will then pass through the space between the main die 12 and the shaping die 18 and one operates the handle 26 so that the shaping die is caused to move around the main die until a marking on the arm 16 is opposite a suitable one of the gradations 56 formed on the main die and as has been indicated on the drawing for that particular bend. At this stage the bend will have been effected at the right place and by the right angular amount.

One can then go back to the drawing and determine what further bend one needs to make. If the bend is perpendicular to the previously formed bend, then the upper face 58 on the abutment is used to engage the abutment face 32 on the abutment 30 and the operation is then repeated.

Of course, one can provide main dies of different size to suit particular angle of bend and one would then need a different length of arm 16. Again, the clamp can have a number of different shapes particularly if one wishes to produce bends at angles other than a right angle.

I claim:

1. A pipe bender assembly comprising a pipe bender and a separate pipe clamp operatively co-operable therewith, the pipe bender including a body, a main die forming part of, or mounted on said body, an at least part annular concave groove on the periphery of said main die, a circular shaping die rotatable about its own axis, which is parallel to the axis of the main die, an annular groove on the periphery of said shaping die, a mounting supporting the shaping die so that it is rotatable about the axis of the main die, a reduction gear operatively associated with said mounting to move said shaping die around the periphery of the main die, and two abutment surfaces on the body of the pipe bender extending adjacent and perpendicular to one another, the pipe clamp comprising a clamp body separate from said pipe bender, a pipe receiving bore through said body, whereby said pipe clamp can be initially clamped on a pipe to be bent, while said pipe is positioned on a separate drawing, an axis to said bore and an outer surface of said body including at least first and second faces each subsequently selectively engagable accurately with said two abutment surfaces effective to position temporarily the pipe clamp with respect to the pipe bender, said first face extending accurately parallel to said axis of said bore and said second face extending accurately perpendicular to said axis of said bore.

2. An assembly according to claim 1, wherein the pipe receiving bore through the clamp forms a tangent to one flat face of said clamp which is parallel to the first face.

3. An assembly according to claim 2, wherein said clamp further comprising a clamping screw enabling the bore to be closed on the pipe to be bent and secured thereto.

4. An assembly as claimed in claim 1, wherein the body further comprises a plate mountable in a vise so that the axis of the main die is substantially vertical.

5. An assembly as claimed in claim 1, wherein the main die further comprises angular scale to indicate an angle by which the pipe is being bent.

* * * * *